United States Patent [19]

Sette et al.

[11] 3,935,800

[45] Feb. 3, 1976

[54] FLAP SEPARATING MECHANISM

[75] Inventors: Paul R. Sette, Hamden, Conn.; Anthony Storace, Tarrytown, NY

[73] Assignee: Pitney-Bowes, Inc., Stamford, Conn.

[22] Filed: Apr. 8, 1974

[21] Appl. No.: 459,037

[52] U.S. Cl. ..... 93/61 R; 53/382; 93/62

[51] Int. Cl.[2] ..... B31B 1/36; B31B 49/04

[58] Field of Search ..... 53/381 R, 382, 384; 93/61 R, 61 B, 62, 63 R, 63 M, 84 R, 84 TW, 28

[56] References Cited

UNITED STATES PATENTS

| | | | |
|---|---|---|---|
| 2,668,053 | 2/1954 | Bach | 53/381 R X |
| 2,939,261 | 6/1960 | Calhoun | 53/381 R |
| 3,015,926 | 1/1962 | Galambos | 53/384 |
| 3,143,838 | 8/1964 | Pouliart | 53/381 R X |
| 3,395,624 | 8/1968 | Seyl | 93/61 R |
| 3,529,756 | 9/1970 | Smith | 53/381 R X |

*Primary Examiner*—James F. Coan
*Attorney, Agent, or Firm*—William D. Soltow, Jr.; Albert W. Scribner; Robert S. Salzman

[57] ABSTRACT

A flap separating mechanism and method for distending a flap from a body portion of an envelope.

An envelope moving through a mail handling system may require its flap to be moistened and sealed. As a prelude to the moistening procedure, the flap of the envelope must be separated from the body portion. The separating mechanism disclosed herein comprises a pivotable elongated bar. An incoming vertically oriented envelope engages a dog-leg bend in the bar causing it to pivot to a deflected position. A weighted lever arm urges the elongated bar to pivot back to its original position, which provides a force to be applied to the back of the envelope. This force "breaks-the-back" of the envelope, which in turn results in distending the flap from the body portion thereof.

8 Claims, 3 Drawing Figures

FLAP SEPARATING MECHANISM

This invention pertains to flap separating mechanisms, and more particularly to a flap separating mechanism and method which "breaks-the-back" of a vertically oriented envelope in order to provide distention of the flap from the body of the envelope.

BACKGROUND OF THE INVENTION

With the modern day need for high speed mail handling systems, it has been found useful to transport envelopes along a mail handling feed path with a vertical orientation. This vertical orientation requires that many basic functions provided by prior machines, such as moistening and sealing of the envelopes, require new mechanisms due to the differences in the mail handling orientation.

As a prelude to the moistening of envelope flaps, it is required that the flap be separated from the body portion of the envelope. With the vertical orientation of the moving piece of mail, it has been discovered that the flap of an envelope can be distended from the body of the letter by applying a force across the back of the envelope. This force makes the body of the letter flex (breaks-the-back of the envelope). The flexure of the envelope body, in turn, causes the flap of the envelope to distend or otherwise separate from the body of the letter.

The flap separating method and system of this invention further provides a solution to a problem inherent with fixed knife-blade type separators. Fixed blade separators cannot distinguish between sealed and unsealed pieces of mail. As a result, if sealed envelopes are fed into a mail handling system having a fixed blade separator, the nose of the sealed flap will be torn or damaged when coming in contact with the blade. In other words, there is no provision in present systems for by-passing the separator blade should mixed mail (sealed and unsealed) be introduced therein.

The present invention resolves the aforementioned problem, and provides a mechanism and method which can be used with mixed mail (sealed and unsealed).

SUMMARY OF THE INVENTION

The method of this invention contemplates separating the flap from the body portion of an unsealed envelope, which is moving through a mail handling system with a substantially vertical orientation. The envelope is transported through the system with the substantially vertical orientation, and then a force is applied to the back of the envelope making the body of the envelope flex. This flexure in turn causes the flap of the letter to separate (distend) from the body of the envelope. The force is generally applied across the entire length of the envelope, while restraining the edge of the envelope. The edge of the envelope is restrained to prevent the envelope from "walking" away from the force applying mechanism, which would reduce the effectiveness of the separating force.

The mechanism for practicing the above-mentioned method comprises a pivotably mounted elongaged bar, which has a dog-leg bend at one end. An incoming piece of unsealed mail engages with the dog-leg bend of the bar, and causes the bar to pivot to a deflected position. As the envelope continues to move forward, the bar is urged back to its original "home" position. The bar presses against the back of the envelope, and the exerted force of the bar makes the body of the letter to flex. This flexure in turn causes the flap to separate from the body of the envelope.

A sealed envelope which travels through the mechanism will likewise receive the same pressure across the back of the envelope, but because the flap is already sealed, the flap will not be caused to separate. Thus, the present invention can be used with both sealed and unsealed pieces of mail.

It is an object of this invention to provide an improved flap separating mechanism and method;

It is another object of the invention to provide a flat separating method and mechanism which can be used with both sealed and unsealed pieces of mail;

It is still another object of this invention to provide a method and mechanism for separating the flap of an envelope from the body portion thereof as the envelope is being transported through a mail handling system with a substantially vertical orientation;

These and other objects of the invention will become more apparent and will be better understood with reference to the following detailed description taken in conjunction with the accompanying drawings, in which.

DETAILED DESCRIPTION

Generally speaking, the invention is for a flap separating method and mechanism for distending a flap from a body portion of an unsealed envelope moving along a feed path of a mail handling system with a substantially vertical orientation. The flap separating mechanism operates to separate the flap from the body of the envelope and then guide the flap and body of the envelope about a guide member. The separating mechanism of this invention comprises means defining an envelope feed path wherein the envelope is transported with a substantially vertical orientation; means for so transporting the envelope; a guide member for receiving and engaging with the envelope moving along the feed path, for receiving and maintaining the flap of the envelope distended from the body of the envelope; and force exerting means disposed ahead of said guide member for receiving an envelope moving along the feed path and for engaging with, and exerting a force upon the body of the envelope. This force makes the body of the envelope flex, which in turn causes the flap to distend from the body of the envelope as the body flexes.

Figure 1:
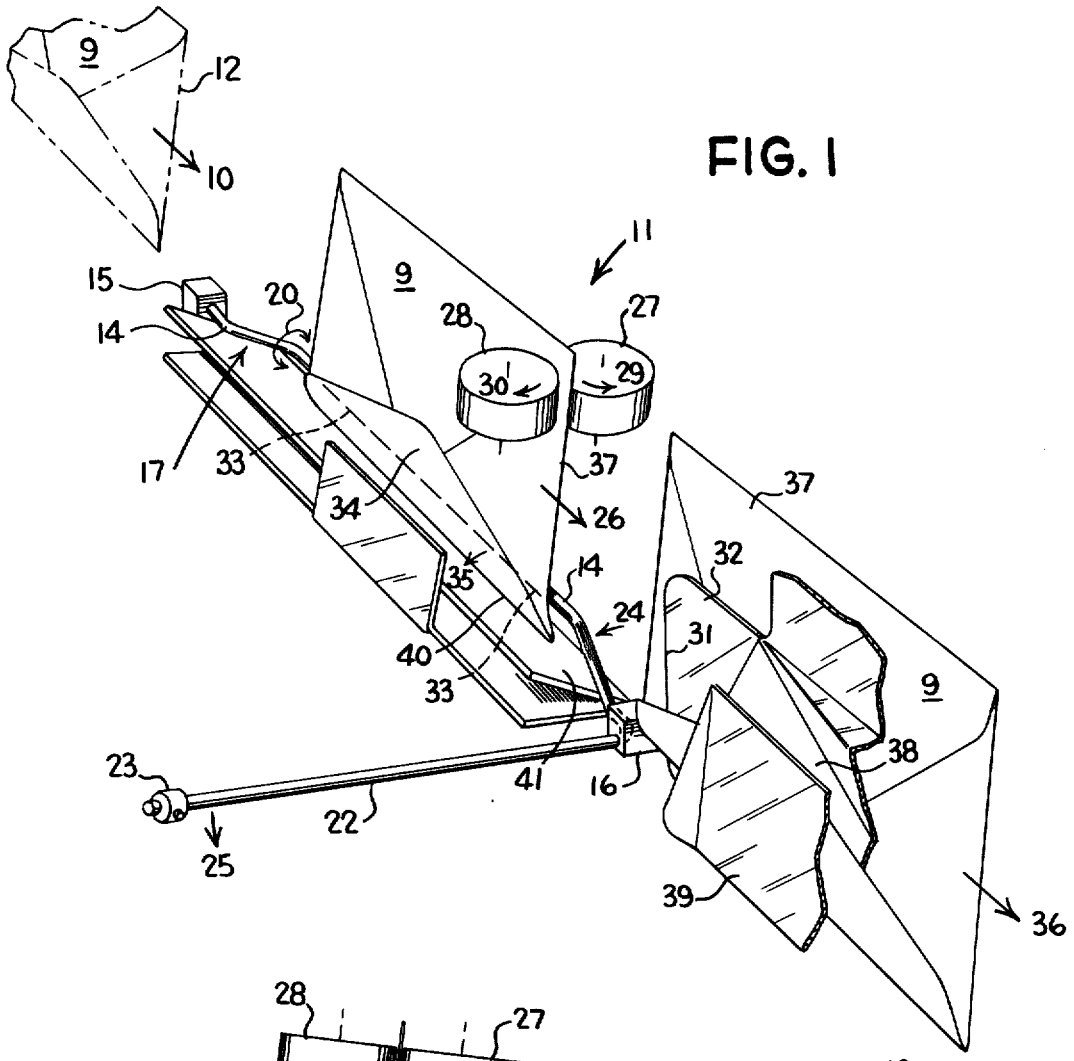
FIG. 1 is a perspective view of the flap separating mechanism of this invention, with the pivot bar shown in a home position overlayed with a phantom view showing the bar in a deflected position.
Figure 2:
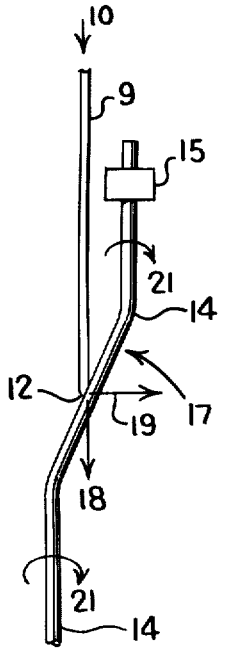
FIG. 2 is a top view of an incoming letter contacting the dog-leg bend of the elongate bar of FIG. 1, causing the bar to pivot to the deflected position shown in phantom in FIG. 1.

Now referring to FIG. 1, an envelope 9 is shown moving along a feed path (arrow 10) of a mail handling system. The envelope 9 has a substantially vertical orientation. The envelope 9 moves toward the flap separating mechanism of this invention, as generally shown by arrow 11. The flap separator mechanism 11 comprises an elongated bar 14, which is pivotably mounted (arrows 20) upon supports 15 and 16, respectively. The bar 14 is initially in a rest or "home" position (solid lines) prior to the receipt of the envelope 9. When the envelope 9 reaches the separator mechanism 11, the leading edge 12 of the envelope strikes a dog-leg bend in bar 14, generally depicted by arrow 17. At the instant of contact, (FIG. 2) the edge 12 causes both a forward and a lateral force to be exerted upon bar 14, as depicted by vector arrows 18 and 19, respectively: the result of this impingement causes the bar 14 to pivot (arrows 21) about pivots 15 and 16, to a deflected position illustrated by phantom lines in FIG. 1.

The elongated bar 14 is rigidly attached to a lever arm 22 at pivot point 16, which lever arm 22 also is caused to assume a deflected position by said impingement, as shown by the phantom lines of the lever arm in FIG. 1. This is so because lever arm 22 is a fixed integral member of bar 14, and both lever arm 22 and bar 14 deflect as a unit mass.

Figure 3:
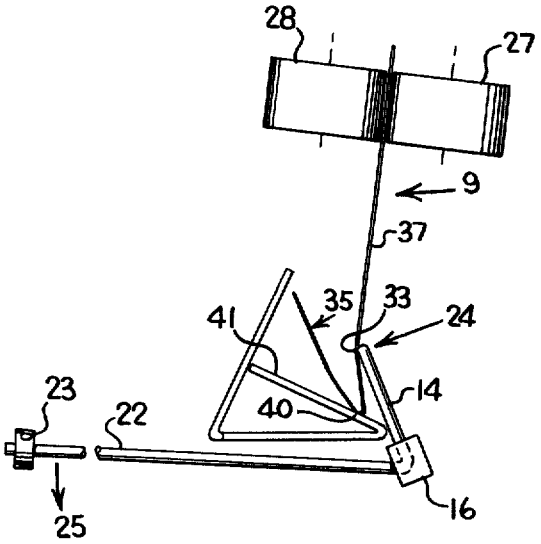
FIG. 3 is a frontal view of the inventive flap separating mechanism of FIG. 1.

The lever arm 22 has a weight 23 attached at its outer end, so that the lever arm 22 exerts a gravitational restoring force (arrow 25) to bar 14, when the bar 14 and lever arm are in a deflected position. When the lever arm 22 tends to move downwardly (arrow 25) due to the force of weight 23, the elongated bar is urged back to its home position (arrow 24) as shown in FIGS. 1 and 3.

After initially contacting bar 14, the envelope 9 continues to move forward (arrow 26), and is caught between drive rollers 27 and 28. Drive rollers 27 and 28 rotate in opposite directions (arrows 29 and 30, respectively) so as to further the forward advance of envelope 9 towards the edge 31 of a fixed blade separator bar 32.

After initially causing the bar 14 to deflect to its deflected position (shown in phantom in FIG. 1), the envelope 9 moves forward (arrow 26) to a position directly opposite bar 14. Now, as the bar 14 is urged (arrow 24) to its home position by the weighted lever arm 22, the bar 14 strikes the back of envelope 9 as illustrated in FIGS. 1 and 3. This causes envelope 9 to flex about contact line 33 (FIG. 1). The flexing of envelope 9 substantially across its entire length (line 33) in turn causes the flap 34 of the envelope 9 to distend or otherwise separate (arrow 35) from the body 37 of the envelope 9.

The envelope 9 is then fed towards fixed plate 32, and the separated flap 34 travels in front of plate 32, while the body 37 of the envelope 9 moves in back of plate 32.

Two additional guide plates 38 and 39, respectively, thereafter guide the flap 34 to a moistening pad (not shown) as the envelope 9 moves forward (arrow 36).

In order that the separating force exerted by bar 14 against the body 37 of the envelope be sufficiently effective, the lower edge 40 of the envelope 9 is restrained from "walking" away from the forwardly exerted force (arrow 24) of the bar 14. This restraint is provided by the inclined surface 41. Now, when the force is applied along line 33 of the envelope, the edge 40 of the envelope is restrained so that the body 37 of the envelope will bend, and the flap 34 will be caused to distend (arrow 35) from the body 37 of the envelope.

Naturally, many modifications and changes may be made in the apparatus of this invention without departing from the inventive concept, to wit: the weighted lever arm 22 can be replaced by a spring, which will urge bar 14 back to its home position, or bar 14 may itself be weighted and designed to seek its home position.

These and other changes will occur to the skilled practitioner are deemed to fall within those limits defining this invention. The spirit and scope of tthe invention should be interpreted with respect to the appended claims.

What is claimed is:

1. A flap separating mechanism for distending a flap from a body portion of an unsealed envelope moving along a feed path of a mail handling system with a substantially vertical orientation, said flap separating mechanism including means to separate the flap from the envelope body portion and then guide the flap and said body portion of the envelope about a guide member, said flap separating mechanism comprising:

means defining an envelope feed path wherein the envelope is transported with a substantially vertical orientation;

transporting means associated with said feed path for transporting envelopes along said feed path with said substantially vertical orientation;

a substantially flat envelope guide member vertically disposed within said feed path for receiving and engaging with an unsealed envelope moving along said feed path, said guide member receiving and maintaining the unsealed envelope with the flap distended from the body portion of said envelope such that said flap will be guided about one side of the guide member and the body portion of the envelope will be guided on an opposite side of said guide member; and force exerting means disposed along feed path ahead of said envelope guide means for receiving an envelope moving along said feed path, said force exerting engaging with, and exerting a force substantially along the entire body portion of an envelope adjacent said flap such that said body portion will be made to flex, the flap of said envelope being caused to distend from said body portion as said body portion is made to flex.

2. The flap separating mechanism of claim 1, wherein said force exerting means comprises an elongated envelope engaging bar which is movably supported within said feed path and which is movable between a rest position and a deflected position, said bar being caused to move from the rest position to said deflected position when a moving envelope engages with the bar, and biasing means operatively connected to said bar for urging said bar towards said rest position such that after said bar has been deflected by said envelope, the bar exerts a flexural force upon said envelope as it tends to return to the rest position.

3. The flap separating mechanism of claim 2, wherein said elongated bar is pivotably mounted, and is caused to pivot between said rest position and said deflected position, and further wherein said biasing means comprises a weighted lever arm extending outwardly from said elongated bar.

4. The flap separating mechanism of claim 3, wherein said elongated bar has a dog-leg bend therein, which is initially engaged by an incoming moving envelope and which said engagement causes said bar to pivot from its rest position as said envelope moves against the dog-leg bend.

5. A flap separating mechanism for distending a flap from a body portion of an unsealed envelope as said envelope moves along a feed path with a substantially vertical orientation, said flap separating mechanism comprising:

means defining an envelope feed path wherein the envelope is transported with a substantially vertical orientation;

transporting means associated with said feed path for transporting envelopes along said feed path with said substantially vertical orientation;

a pivotably mounted elongated bar member disposed along said feed path and pivotably movable between a home position and a deflected position, said bar member being engaged by a moving envelope such that said bar member is caused to pivot towards said deflected position; and biasing means operatively connected to said bar member for urging said bar member towards said home position, whereby said bar will be caused to exert a flap separating force upon the body portion of an envelope which has caused the bar to pivot from the home position.

6. The flap separating mechanism of claim 5, wherein said elongated bar member has a dog-leg bend which initially is engaged by an incoming moving envelope, and which said engagement causes said bar to pivot from its rest position as said envelope moves against the dog-leg bend.

7. The flap separating mechanism of claim 5, wherein said biasing means comprises a weighted lever arm extending outwardly from said elongated bar member.

8. A method of separating a flap from a body portion of an unsealed envelope moving through a mail handling system with a substantially vertical orientation, said method comprising the steps of:

A. transporting an envelope through a mail handling system with the envelope having a substantially vertical orientation; and B. applying a force to substantially an entire length of an outer surface portion of the envelope adjacent said flap, while restraining an edge portion of the envelope, such that the body portion of the envelope will be made to flex, which in turn causes the flap of the envelope to separate from said body portion thereof.

* * * * *